US010431883B2

(12) United States Patent
Gao et al.

(10) Patent No.: US 10,431,883 B2
(45) Date of Patent: Oct. 1, 2019

(54) ANTENNA SYSTEM FOR DOWNHOLE TOOL

(71) Applicant: Schlumberger Technology Corporation, Sugar land, TX (US)

(72) Inventors: Jianjie Gao, Shanghai (CN); Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 516 days.

(21) Appl. No.: 14/807,843

(22) Filed: Jul. 23, 2015

(65) Prior Publication Data

US 2016/0072184 A1 Mar. 10, 2016

Related U.S. Application Data

(60) Provisional application No. 62/047,031, filed on Sep. 7, 2014.

(51) Int. Cl.

| | |
|---|---|
| ***H01Q 1/40*** | (2006.01) |
| ***E21B 47/12*** | (2012.01) |
| ***H01Q 7/00*** | (2006.01) |
| ***H01Q 1/04*** | (2006.01) |

(52) U.S. Cl.

CPC ..... *H01Q 1/40* (2013.01); *E21B 47/122* (2013.01); *H01Q 1/04* (2013.01); *H01Q 7/00* (2013.01)

(58) Field of Classification Search

CPC .. H01Q 1/04; H01Q 1/40; H01Q 7/00; H01Q 1/27; E21B 47/122; E21B 7/04

See application file for complete search history.

(56) References Cited

U.S. PATENT DOCUMENTS

2004/0200613 A1* 10/2004 Fripp ..... E21B 47/0006 166/250.01
2008/0022506 A1* 1/2008 Bittner ..... G01R 33/3802 29/599
2010/0244824 A1* 9/2010 Jiang ..... G01R 33/3802 324/309
2012/0061380 A1* 3/2012 Parsche ..... E21B 36/04 219/618
2013/0088364 A1* 4/2013 Bittar ..... E21B 47/01 340/856.3
2014/0232611 A1* 8/2014 Ochoa ..... H01Q 1/288 343/881
2014/0339938 A1* 11/2014 Passman ..... F01D 17/162 310/88
2014/0368197 A1* 12/2014 Wang ..... G01V 3/12 324/333
2014/0368198 A1* 12/2014 Espinosa ..... E21B 47/122 324/333

(Continued)

*Primary Examiner* — Graham P Smith
*Assistant Examiner* — Jae K Kim

(57) ABSTRACT

A technique facilitates communication of signals in a downhole environment. According to an embodiment, the system comprises an antenna which may be combined with a well component for communicating signals along a wellbore. The antenna comprises wire which is coated with a suitable material, such as amorphous polyetheretherketone (PEEK), and wet wound into a coil. A plurality of protective elements may be combined with the wire, e.g. sleeves may be placed over portions of the wire to protect the wire. Layers of tape also may be wrapped around coil to enhance durability of the antenna.

11 Claims, 1 Drawing Sheet

(56) References Cited

U.S. PATENT DOCUMENTS

| | | | | |
|---|---|---|---|---|
| 2014/0368200 | A1* | 12/2014 | Wang | G01V 3/28<br>324/338 |
| 2015/0090494 | A1* | 4/2015 | Lazarev | E21B 47/122<br>175/40 |
| 2015/0276459 | A1* | 10/2015 | Sai | G01F 23/284<br>73/290 V |
| 2016/0053596 | A1* | 2/2016 | Rey | E21B 43/2401<br>166/302 |

* cited by examiner

ANTENNA SYSTEM FOR DOWNHOLE TOOL

CROSS-REFERENCE TO RELATED APPLICATIONS

The present document is based on and claims priority to U.S. Provisional Application Ser. No. 62/047,031, filed Sep. 7, 2014, which is incorporated herein by reference in its entirety.

BACKGROUND

In many hydrocarbon well applications and other applications, communication systems are used for communicating signals between components in a wellbore. The communication systems also may be used for communicating between a surface system and a downhole system. In some communication systems, a downhole component may be constructed with an antenna for sending and/or receiving communication signals. However, the antenna can be susceptible to the high temperatures, pressures, and generally deleterious conditions of the downhole well environment.

SUMMARY

In general, a system and methodology are provided for communicating signals, e.g. communicating signals in a downhole environment. According to an embodiment, the system comprises a component having an antenna for communicating signals along a borehole. The antenna comprises wire which is coated with a suitable material, such as amorphous polyetheretherketone (PEEK), and wet wound into a coil. A plurality of protective elements may be employed to protect the antenna wire and to provide a durable antenna coil. For example, sleeves may be placed over portions of the wire to protect the wire. Additionally, a layer of tape may be wrapped around the coil such that the combination of wet winding and protective measures provides a durable antenna for long-term use in a downhole environment.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate the construction of an antenna for communicating signals, e.g. communicating signals in a downhole environment. The technique comprises constructing an antenna and combining the antenna with a component to facilitate long-term communication of signals along a borehole, e.g. along a wellbore. The antenna comprises wire which is coated with a suitable material, e.g. amorphous polyetheretherketone (PEEK), and wet wound into a coil. A plurality of protective elements may be used to ensure the longevity of the antenna, including tightly wrapping the wet wound wire. Additionally, sleeves may be placed over portions of the wire to protect the wire. By way of further example, a layer of tape may be wrapped around the coiled wire to protect the exterior of the antenna coil and to provide a durable antenna for long-term use in a downhole environment.

According to an embodiment, a process is provided for packaging an antenna which can be used in downhole environments, such as downhole environments with pressures of at least 37 ksi and temperatures of at least 150° C. The completed antenna may be used with a variety of downhole components for communicating real-time signals, e.g. sending real-time signals to other downhole components. An example of a downhole component which may incorporate the antenna is the PowerDrive™ control unit available from Schlumberger Corporation. However, the process for packaging the antenna may be used to form antennas for combination with a variety of other components, such as electrical motors and generators. The process enables construction of the antenna in a manner which provides a durable antenna able to withstand and operate at high temperatures and pressures. Various aspects of the process for packaging may comprise certain epoxy formulations, amorphous PEEK coated wire with a predetermined copper core size, a wet winding and pre-potting procedure, and a subsequent potting procedure.

Figure 1:
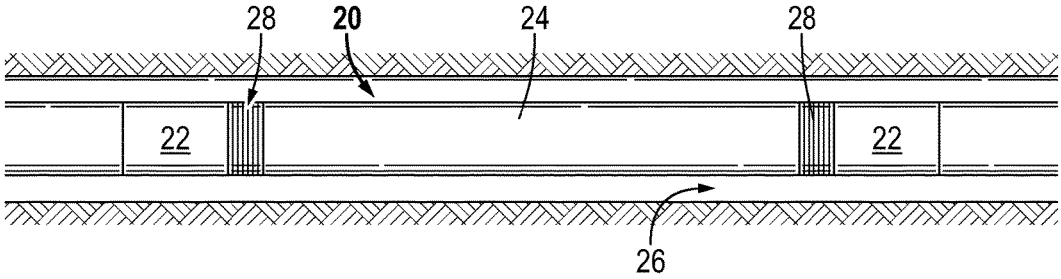
FIG. 1 is a schematic illustration of a well system comprising at least one downhole component coupled with an antenna for communicating signals along a borehole, according to an embodiment of the disclosure.

Referring generally to FIG. 1, an example of a downhole system 20 comprising a plurality of downhole components 22 is illustrated. The downhole components 22 are positioned in a tool string 24 deployed downhole in a borehole 26, e.g. a wellbore. At least one of the components 22, and often a plurality of the components 22, comprises an antenna 28 which is used for communicating signals, e.g. sending signals, along borehole 26 to other components. In some applications, the antenna 28 also may be used for receiving signals. For example, a first component 22 may be coupled with the corresponding antenna 28 to output signals for transmission of signals along borehole 26. The signals may transmitted to a second component 22 coupled with its corresponding antenna 28 which is used for receiving the signals from first component 22. Additionally, the antenna 28 may be used for communicating with surface components in some applications.

Figure 2:
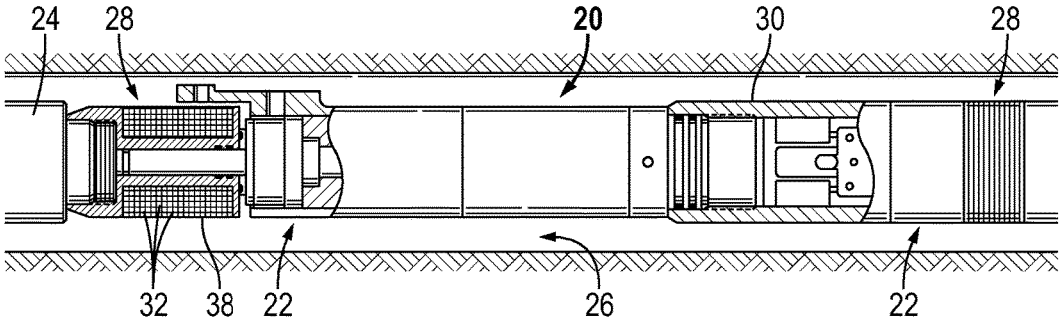
FIG. 2 is a cross-sectional illustration of an example of a well tool incorporating an embodiment of an antenna, according to an embodiment of the disclosure.

Depending on the application, the components 22 may comprise many types of components which communicate signals, e.g. output signals and/or receive signals, with respect to other components. For example, one of the components 22 may utilize the corresponding antenna 28 to output control signals which are received by a second component 22 which is in the form of a controlled device. In various embodiments of the downhole system 20, the components 22 may comprise several types of components, including motors, generators, control systems, solenoids, bi-stable actuators, e.g. linear motors, or control units. In many of these examples, the antenna 28 is wound as a coil and in some applications the coil antenna 28 also serves to enable other functions of the component 22, e.g. activation or power generation. As illustrated in FIG. 2, for example, one of the components 22 is a control unit 30, e.g. a PowerDrive™ control unit available from Schlumberger Corporation, which has a coil formed to function as antenna 28. The control unit 30 may be used for controlling a steerable drilling system, such as a rotary steerable drilling system. In this example, the control unit 30 outputs control signals via the corresponding coil antenna 28 and those control signals are received by the steerable drilling system. By way of example, the control signals may be directional control systems used to control the steerable drilling system in a manner which enables drilling of a borehole along a desired trajectory.

Figure 3:
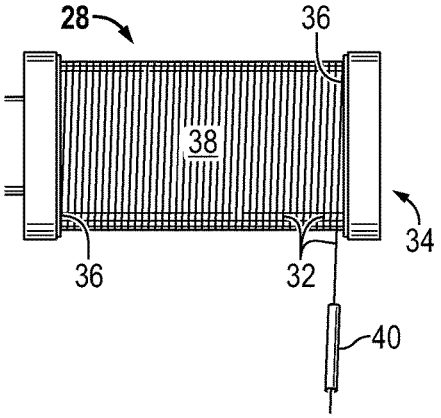
FIG. 3 is a schematic illustration of an example of an antenna having a coated antenna wire wet wound into an antenna coil, according to an embodiment of the disclosure.
Figure 4:
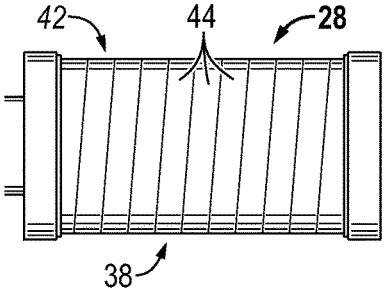
FIG. 4 is an illustration of an example of a completed coil wrapped in an outer layer of protective tape, according to an embodiment of the disclosure.

With additional reference to FIG. 3, the antenna 28 may be formed by wrapping an antenna wire 32 around a coil former 34. The antenna wire 32 may be formed of a copper material coated with amorphous PEEK or other suitable coating material. In some applications, a protective layer 36, e.g. a protective tape layer, is initially placed along the contact surfaces of the coil former 34. The antenna wire 32 is then wet wound over the protective layer 36 to form a coil 38. Portions of the antenna wire 32, e.g. the beginning portion and ending portion, may be protected with a sleeve or sleeves 40. Additionally, the coil 38 may be covered in a protective layer 42, such as a layer formed by wrapping a tape 44 around the coil, as illustrated in FIG. 4. In some applications, the protective layer 42 is in the form of a thin metal skin sleeve or a thin metal skin sleeve disposed about the tape 44.

The protected coil 38 may then be assembled into a potting mold and potted with an improved potting material to form the completed coil antenna 28. Once the coil antenna 28 is completed, the coil antenna 28 may be operatively coupled with the desired component 22 used to output or receive signals via the antenna, as illustrated in the embodiment of FIG. 2. In some applications, the coil antenna 28 may be completed while coupled with the corresponding component 22.

Various materials may be employed and various adjustments to the procedure described above may be made with respect to the process of constructing the antenna 28. In the following discussion, specific examples of various materials and/or techniques are provided, but these examples are to facilitate an understanding of the process and should not be considered as specifically limiting. The various products, components and techniques used in constructing the completed coil antenna 28 have been used to improve the durability of the antenna 28 in high temperature, high pressure environments, such as downhole environments.

The glass transition temperature (TG) and compression strength of the antenna 28 may be improved by employing potting materials able to withstand the high temperature, high pressure environments. Examples of suitable potting materials include epoxy materials, e.g. Huntsman© LY5210/HY5212 and Huntsman© LY8615/Aradur8615 epoxies used as potting compound systems. These types of potting compound systems provide substantially improved strength and also an improved TG often of at least 200° C.

According to an example of an operational procedure, the coated antenna wire 32 is formed into coil 38 via wet winding with high viscosity epoxy material, e.g. Huntsman© LY5210/HY5212, followed by vacuum potting with an epoxy material, e.g. Huntsman© LY8615/Aradur8615. However, various other materials, e.g. other epoxy materials, can be used for wet winding and potting. In an embodiment, the wet winding material comprises an epoxy system which, when cured, has approximately a flexural strength of 88 MPa; a flexural modulus of 3500 MPa; a compressive strength of 153 MPa; and an impact strength of 3 $KJ/m_2$. Similarly, the potting material may comprise an epoxy system which, when cured, has similarly extensive ranges of properties.

In a specific example, the potting material has a glass transition temperature of at least 180° C. (following a post cure). In this example, certain properties of the potting material comprise a flexural strength range of approximately 82-124 MPa at 23° C. and 37-62 MPa at 150° C.; a flexural modulus range of approximately 5.1-5.6 GPa at 23° C. and 2.3-2.4 GPa at 150° C.; and a compressive strength range of approximately 341-354 MPa at 23° C. and 199-209 MPa at 150° C. The epoxy materials selected for wet winding and/or potting may vary according to the desired properties for a given application.

By way of example, the antenna wire 32 may be formed with a conductive core material, such as a copper wire or other conductive metal wire, covered with a PEEK coating which has substantial cut through resistance capability. In this example, the PEEK is in amorphous status. Thus, the coating material can bind better than crystalline form and can deform with the copper wire core without cracking and peeling off. Additionally, the size of the antenna wire 32, e.g. the copper conductor core, may be relatively small, e.g 20 AWG (American Wire Gauge) or smaller in diameter, to reduce the stress experienced at crossover points of different layers of the antenna wire 32 as the antenna wire 32 is wet wound into antenna coil 38. The wet winding further ensures that voids and gaps are filled during winding and it also provides support to the coil 38 to reduce or prevent relative movement between the wires 32 when subjected to pressure. For example, high pressures (greater than 32 ksi) and high temperatures (e.g. 304° F.) have been found to form the copper wire core which can cause damage to the wire coating for larger wires, e.g. wires larger than 20 AWG in diameter.

During the wet winding process, certain portions of the antenna wire 32 may be further protected with the sleeve or sleeves 40. For example, certain areas of the winding, such as the lead into and out of a winding bobbin area, may be shrouded in the sleeves 40 for added protection. By way of example, the sleeves 40 may be formed of PEEK material. Once the wire 32 is wet wound, the coil of wire may be covered with protective layer 42, e.g. tape 44.

In an embodiment, the tape 44 is a glass tape which is wrapped around the coil of wire 32 after wet winding to create the protective layer 42. In this example, the protective layer 42 slows down or reduces the epoxy leakage from the coil 38 and provides additional insulation between the coil of wire 32 and an outer skin, such as an outer metal skin. The protective layer 42 also helps avoid potting cracking as a result of differing thermal expansion rates between the winding and the epoxy of the potting material.

In a specific example of a process for constructing the antenna 28, the coil former 34 is initially inspected for cuts or surface imperfections to avoid issues when the coil is placed under pressure. The coil former 34 can then be wrapped with tape and also have its vertical walls covered with tape, e.g. a covering of two layers of polyimide film tape, e.g. Kapton™ tape available from DuPont Corporation, which provides a layer of protection and insulates the coil former 34 from the wire 32. The polyimide film tape may be brushed with an epoxy material, e.g. Huntsman© LY5210/HY5212 or other suitable material. The antenna 28 may then be formed by wet winding with an epoxy material, e.g. Huntsman© LY5210/HY5212 (ratio 100/40 in weight) applied with a suitable applicator, e.g. a hand or automated paintbrush, on the coil former tape and on the amorphous PEEK coated wire 32. The wire 32 is tightly packed to limit or avoid the opportunity for movement. As discussed above, however, the epoxy materials selected may vary according to the desired properties for a given application.

In this embodiment, the start and end of the winding may be protected with the PEEK sleeves 40 where the wire 32 enters and exits through the metalwork of the antenna 28. 20 AWG amorphous status PEEK coated wire 32 may be used for the winding. Additionally, protective layer 42 may be positioned over the coil 38 of wire 32. By way of example, the protective layer 42 may comprise tape 44 in the form of a single layer of fiberglass woven tape (e.g. weighing 175 $g/m^2$). The tape 44 is placed on top of the winding as soon as the coil 38 is wound to limit or prevent loss of epoxy from the coil.

The coil 38 is then assembled into a potting mold which is placed in a pressure vessel. By way of example, the pressure vessel may be set to a pressure of at least 40 psi and a temperature of at least 122° F. for at least 12 hours. The antenna coil 38 may be potted with an epoxy material, e.g. Huntsman© LY8615/Aradur8615/silica 800 (ratio 100/50/115 in weight) at 122° F. As discussed above, however, the epoxy materials selected may vary according to the desired properties for a given application. The antenna coil 38 may then be moved to a pressure vessel set to a pressure of at least 40 psi and a temperature of at least 122° F. for at least 12 hours.

In a specific example, the pressure vessel is operated at 40 psi and a temperature of 122° F. for 12 hours. The antenna coil 38 is then moved to an oven for a post cure. Subsequently, the antenna coil 38 may be de-molded, machined, assembled to a sleeve, and welded to the appropriate downhole component 22. However, the antenna coil 38 may be fastened to the downhole component 22 by other fastening techniques, e.g. by using threaded fasteners, interlocking mechanisms, or other suitable fastening systems. The wire 32 of coil 38 also is operatively coupled with the appropriate downhole component 22.

Various post cure cycles may be applied. However, a specific example comprises curing the antenna coil 38 by maintaining the temperature at 122° F. for one hour. While limiting the temperature increase to 0.54° F. per minute or less, raising the temperature to 140° F. and curing for two hours. Then, while limiting the temperature increase to 0.54° F. per minute or less, raising the temperature to 176° F. and curing for two hours. An additional temperature increase is limited to 0.54° F. per minute or less while raising the temperature to 212° F. and curing for two hours. A further temperature increase is limited to 0.54° F. per minute or less while raising the temperature to 248° F. and curing for two hours. A further temperature increase is limited to 0.54° F. per minute or less while raising the temperature to 284° F. and curing for two hours. A further temperature increase is limited to 0.54° F. per minute or less while raising the temperature to 320° F. and curing for two hours. A further temperature increase is limited to 0.54° F. per minute or less while raising the temperature to 356° F. and curing for two hours. Once this temperature is reached, a temperature decrease is limited to 0.54° F. per minute or less while reducing the temperature to 140° F. for machining to avoid cracking. However, some processes may utilize other post cure cycles.

The embodiments described above enable formation of an antenna which is durable and may be used in high pressure, high temperature, downhole environments. The coil type antenna may be used with a variety of components for sending (and/or receiving) communication signals along a borehole, e.g. along a wellbore. The size of the coil may vary and the number and type of coil wraps may be adjusted according to the parameters of given application.

Additionally, the size of the wire conductive core also may vary and may be smaller in diameter than 18 AWG in some applications but often 20 AWG or smaller to reduce stress and damage to the coil. Some applications may utilize other materials or alloys for the conductive material used to form the wire and other protective coatings may be applied to the wire. Similarly, the potting process and curing process may be adjusted according to the characteristics of a given high-temperature epoxy employed as the potting material.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for communicating signals, comprising:

a plurality of components positioned in a wellbore, at least one of the components being coupled with an antenna for communication of signals along the wellbore, the antenna comprising:

a coil of wire which is wet wound, the wire having a conductive core coated with amorphous polyetheretherketone (PEEK), the wire further having a beginning portion and an ending portion which extend away from the coil for connection with the at least one of the components;

a first protective sleeve placed over the beginning portion of the wire and a second protective sleeve placed over the ending portion of the wire to protect the wire where it extends away from the coil; and a layer of glass tape wrapped around the coil.

2. The system as recited in claim 1, wherein the plurality of components comprises a control unit for controlling a steerable drilling system, the antenna being coupled to the control unit to communicate signals from the control unit.

3. The system as recited in claim 1, wherein the wire is wet wound with an epoxy material.

4. The system as recited in claim 1, wherein the wire is no larger than 20 American Wire Gauge (AWG) in diameter.

5. The system as recited in claim 1, wherein the coil of wire is potted in a potting material.

6. The system as recited in claim 5, wherein the potting material comprises an epoxy material.

7. The system as recited in claim 1, wherein the sleeves are formed of PEEK.

8. The system as recited in claim 1, wherein the layer of glass tape comprises a layer of fiberglass woven tape.

9. A system for use in a well, comprising:

a first component located in a wellbore, the first component generating signals;

a second component located to receive the signals generated by the first component; and an antenna coupled to the first component to output the signals to the second component, the antenna comprising:

a coil of conductive wire coated with an epoxy material, the conductive wire further having a beginning portion and an ending portion which extend away from the coil for connection with at least one of the first component and the second component;

protective sleeves placed over the beginning portion and the ending portion to protect the conductive wire where it extends away from the coil; and a layer of glass tape wrapped around the coil.

10. The system as recited in claim 9, wherein the conductive wire is formed into the coil via wet winding.

11. The system as recited in claim 9, wherein the conductive wire is less than 20 AWG in diameter.

* * * * *